United States Patent [19]

White

[11] Patent Number: 4,932,696

[45] Date of Patent: Jun. 12, 1990

[54] FASTENING SYSTEM FOR WINDOW OR THE LIKE

[75] Inventor: Paul S. White, Barnsley, England

[73] Assignee: Crompton Limited, Lancanshire, England

[21] Appl. No.: 314,708

[22] Filed: Feb. 22, 1989

[30] Foreign Application Priority Data

Feb. 27, 1988 [GB] United Kingdom ..... 8804640

[51] Int. Cl.[5] ..... E05C 9/04

[52] U.S. Cl. ..... 292/336.3; 292/39

[58] Field of Search ..... 292/28, 38, 39, 50, 292/51, 125, 171, 225

[56] References Cited

U.S. PATENT DOCUMENTS

| | | | |
|---|---|---|---|
| 2,066,705 | 1/1937 | Vazquez | 292/39 X |
| 4,199,176 | 4/1980 | Kelly | 292/38 |
| 4,616,864 | 10/1986 | Douglas | 292/39 X |

FOREIGN PATENT DOCUMENTS 1499831 2/1978 United Kingdom .

*Primary Examiner*—Richard E. Moore

*Attorney, Agent, or Firm*—Leydig, Voit & Mayer

[57] ABSTRACT

A window fastening system has a toothed drive belt extending around the periphery of a frame of the window to operate fasteners at various points on the frame. An end of the belt is connected to a drive member via a toggle mechanism arranged to draw the belt end and the drive member together and to hold them together.

7 Claims, 2 Drawing Sheets

FASTENING SYSTEM FOR WINDOW OR THE LIKE

BACKGROUND TO THE INVENTION

1. Field of the Invention

This invention relates to a fastening system for a window, door, or other openable panel (herein referred to for convenience as a window), the system comprising a toothed drive belt arranged to extend around the peripheral frame of the window and to operate fasteners at respective points on the frame.

2. Review of the Prior Art

An example of such a fastening system is disclosed in our British patent 1499831. More particularly, the invention relates to a means for providing a driving connection to the drive belt and for ensuring that the belt is correctly tensioned. It will be appreciated that correct operation of such a fastening system is dependent, inter alia, on the belt being installed under an appropriate tension so that no slack can develop therein.

SUMMARY OF THE INVENTION

According to a first aspect of the invention, there is provided a window fastening system comprising a toothed drive belt for arrangement around a peripheral frame of the window and to operate fasteners at respective points on the frame, and a connecting means for the belt having a belt holding member arranged to hold an end of the drive belt, a drive member movable along a part of the frame of the window, and a toggle mechanism arranged to draw the belt holding member and drive member together to an operative position and to hold them in such a position.

According to a second aspect of the invention, there is provided a connecting means for use in an window fastening system, the system also including a toothed drive belt for arrangement around a peripheral frame of the window and to operate fasteners at respective points on the frame, wherein the connecting means comprises a belt holding member arranged to hold an end of the drive belt, a drive member movable along a part of the frame of the window, and a toggle mechanism arranged to draw the belt holding member and drive member together to an operative position and to hold them in such a position.

BRIEF DESCRIPTION OF THE DRAWING

These and other features of the invention will now be described by way of example with reference to the accompanying drawings in which.

DESCRIPTION OF THE PREFERRED EMBODIMENTS

Figure 1:
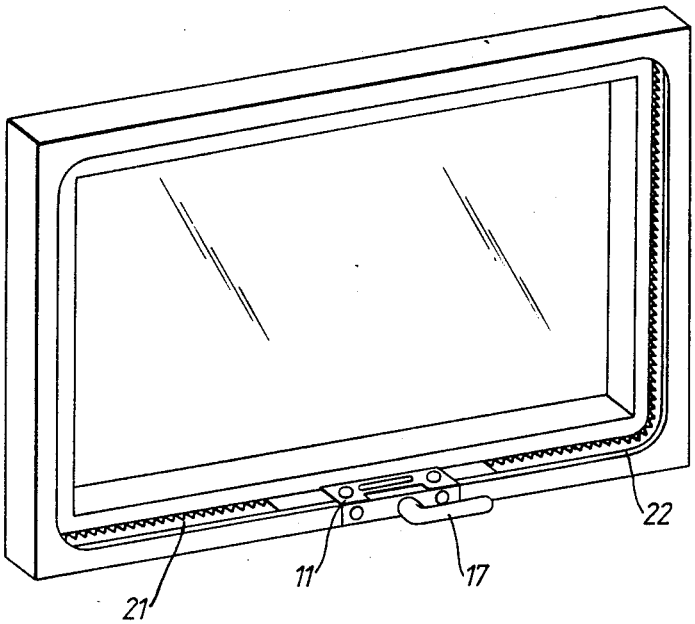
FIG. 1 is a schematic view of a window fastening system embodying the invention.

As above described, the invention relates to a fastening system for a window or the like, wherein a toothed drive belt extends, as shown in FIG. 1, around the peripheral frame of the window and is arranged to operate fasteners spaced therearound. In use, the belt moves around the peripheral frame, being directed around the corners thereof by suitable guide arrangements. Movement of the belt in one directional sense causes the operation of the fasteners. The construction hereafter described provides a drive mechanism for causing such movement of the belt, as well as for connecting the ends of the belt in such a way as to tension the belt.

Figure 2:
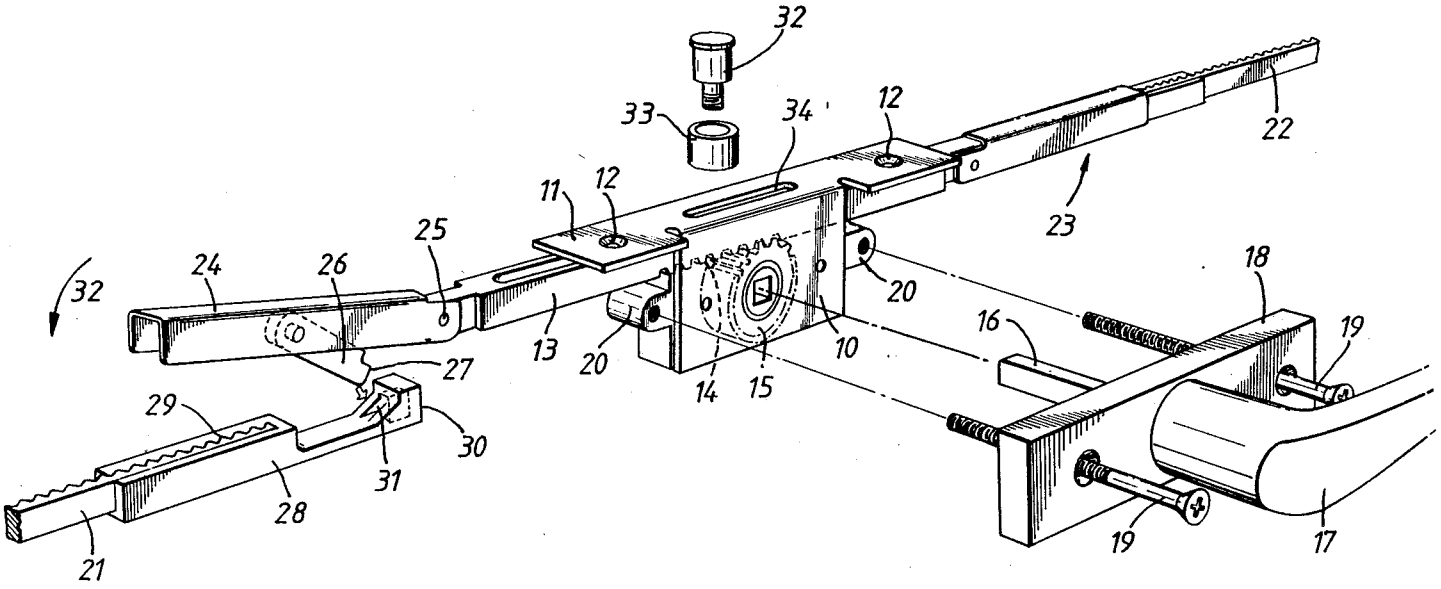
FIG. 2 is an exploded perspective view of the connecting means of the fastening system of FIG. 1.

The mechanism illustrated in FIG. 2 is intended to be installed by being set into a suitable recess in a frame member at one edge of a window or the like. A groove extends in the frame members around the entire periphery of the window, to receive the drive belt. The mechanism comprises a casing 10 to be fitted in the recess provided by an enlargement of such grooves, the casing having a face plate 11 with holes 12 to receive fixing screws. A drive member 13 is supported in the casing immediately beneath the face plate 11, for sliding movement along the groove in the frame member, and is provided with slots for the fixing screws to pass through, and with a rack formation 14 with which engages a pinion 15 rotatably supported in the casing 10. The pinion 15 has a square central aperture with which is engaged a square section shaft 16 extending from a handle 17 angularly movable relative to a base plate 18. The base plate 18 is held to the frame member of the window by screws 19 which engage screw-threaded bores in lugs 10 on the casing 10.

In the drawing are seen respective end parts 21, 22 of a toothed drive belt extending around the peripheral frame of the window in the groove as above described. The end part 22 of the belt is connected to the transmission member 13 by a connecting arrangement which is indicated generally at 23 in the condition it assumes in use. The corresponding connecting mechanism for the end part 21 of the belt is shown prior to reaching the fully installed condition.

A toggle lever 24 is pivotally connected, by a rivet 25, to the end of the drive member 13. The lever 24 is of sheet metal and of U-shape in cross-section. Pivoted to the lever 24 substantially in the centre thereof is a shorter arm 26 having a notched end part 27. The end part 21 of the belt is held by a belt holding member 28 which has a groove 29 therein of which one side is flat and the other side has a toothed profile corresponding to the teeth on the drive belt. Thus, the belt can be inserted into the groove 29 in the direction parallel to the teeth thereon, and will be held in such groove against removal therefrom in the direction lengthwise of the belt. The belt holding member further comprises an upstanding formation 30 affording a socket 31 which is able to receive the end part 27 of the arm 26.

The method of installation of the fastening system to a window frame, in respect of the drive belt, is that the length of the belt will be selected to suit the size of the window. The ends of the belt will be fitted to the belt holding members as 28. The connection of each belt holding member to the drive member 13 will be effected by engaging the end of the respective arm 26 with the formation 31 on the belt holding member whilst the belt holding member is spaced from the drive member, after which toggle lever 24 can be pivoted in the direction of arrow 32 to draw the belt holding member towards the drive member and tension the belt. Ultimately, the belt holding member lies within the U-shaped section of the toggle lever 24 as shown for the connecting mechanism 23. The assembly will be completed by fitting of respective cover plates, not shown, to cover the groove within which the belt, belt holding members, drive member and toggle mechanisms then lie, which will ensure that there is no possibility of unintentional release thereof.

Although the toggle mechanisms and associated parts are above described in association with a rack and pinion operating mechanism and associated handle, the principle of the toggle mechanism for connecting the belt ends to a drive member could be applied to any convenient position in a window fastening system of the type with which the invention is concerned. For example, such a connecting arrangement could be provided in association with one of the fasteners which the belt operates at a selected position on the window frame. It would be possible for the drive member to which the belt holding member is connected to comprise simply another belt holding member, which may hold the opposed end of the belt in a groove of the configuration of groove 29. In any event, the use of the toggle mechanism as above described provides a convenient and compact method of connecting the belt and ensuring correct tensioning thereof as above described.

In the above described example, a peg 32 providing a support for a roller 33 is provided, the peg having a part which has screw-threaded engagement with the drive member 13 to be moved therewith. The threaded part of peg 32 extends through an elongate aperture 34 in the face plate 11. The roller forms part of the system of fasteners for the window.

I claim:

1. A window fastening system comprising a toothed drive belt for arrangement around a peripheral frame of the window and for operating fasteners at respective points on the frame, and connecting means for the belt having a belt holding member arranged to hold an end of the drive belt, a drive member movable along part of a frame of a window, and a toggle mechanism arranged to draw the belt holding member and drive member together to an operative position and to hold them in such a position.

2. A window fastening system according to claim 1 wherein the belt profile corresponding to the toothed profile of the belt, into which the belt is insertable in a direction transverse to its length to be held therein against removal therefrom in the direction along its length.

3. A window fastening system according to claim 1 or claim 2 wherein the toggle mechanism comprises a toggle lever pivotally connected to the drive member, and an arm pivotally connected to the toggle lever and engagable with a formation on the belt holding member.

4. A window fastening system according to claim 3 wherein the lever is of U-section and the belt holding member is able to lie within the lever when in said operative position.

5. A window fastening system according to claim 1 and further including an operating member, the drive member being movable by the action of the operating member in order to operate the fasteners at respective points on the frame.

6. A window fastening system according to claim 5 wherein the drive member has a rack formation engaged with a pinion rotatable by a manually operable handle.

7. A connecting means for use in a window fastening system, the system also including a toothed drive belt for arrangement around a peripheral frame of the window and for operating fasteners at respective points on the frame, wherein the connecting means comprises a belt holding member arranged to hold an end of a drive belt, a drive member movable along a part of a frame of a window, and a toggle mechanism arranged to draw the belt holding member and drive member together to an operative position and to hold them in such a position.

* * * * *